US006578231B1

(12) United States Patent
Godshaw et al.

(10) Patent No.: US 6,578,231 B1
(45) Date of Patent: Jun. 17, 2003

(54) LUGGAGE HANDLE

(75) Inventors: Donald E. Godshaw, Evanston, IL (US); Andrezj M. Redzisz, Wheeling, IL (US); Zbigniew Marchwiak, Chicago, IL (US); Marian Klysz, Elk Grove Village, IL (US); Iwona Malgorzata Marchwiak, Chicago, IL (US); Zoran H. Gracer, Deerfield, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 0 days.

(21) Appl. No.: 09/945,461

(22) Filed: Aug. 30, 2001

(51) Int. Cl.[7] ..... A45C 7/00; A45C 13/22

(52) U.S. Cl. ..... 16/114.1; 16/422; 16/426; 16/429; 16/444; 294/153; 24/302

(58) Field of Search ..... 16/114.1, 113.1, 16/411, 422, 426, 429, 443, 444, 446; 294/137, 153; 119/772, 771; 24/614, 615, 170, 197, 302, 298; D8/7–10, 107; D12/16, 174, 178; D34/27, 15

(56) References Cited

U.S. PATENT DOCUMENTS

| | | | | | |
|---|---|---|---|---|---|
| 2,743,115 | A | * | 4/1956 | Rutledge | D8/10 |
| 3,653,474 | A | | 4/1972 | Sadow | |
| 3,752,474 | A | * | 8/1973 | Macabet et al. | 482/131 |
| 3,913,172 | A | | 10/1975 | Richards et al. | |
| 3,924,872 | A | | 12/1975 | Sollazzi et al. | |
| 4,114,838 | A | | 9/1978 | Knauf | |
| 4,266,867 | A | * | 5/1981 | Reeberg | 24/302 |
| 4,402,542 | A | | 9/1983 | Kreutzer | |
| 4,558,896 | A | | 12/1985 | Farnsworth | |
| 4,610,476 | A | * | 9/1986 | Keiner | 294/149 |
| 4,696,505 | A | * | 9/1987 | Shadoan | 294/153 |
| 4,730,863 | A | | 3/1988 | Guadnola | |
| 4,838,396 | A | | 6/1989 | Krenzel | |
| 5,090,691 | A | | 2/1992 | Pollock | |
| D331,652 | S | * | 12/1992 | Wu | D34/27 |
| 5,405,002 | A | | 4/1995 | Troia | |
| D367,142 | S | * | 2/1996 | Platt | D34/27 |
| 5,518,486 | A | * | 5/1996 | Sheeler | 482/131 |
| 5,566,870 | A | | 10/1996 | Mejeur | |
| 5,704,672 | A | | 1/1998 | Sims et al. | |
| 5,722,118 | A | | 3/1998 | Hansen et al. | |
| 5,829,559 | A | * | 11/1998 | Nordstrom et al. | 190/102 |
| 5,878,853 | A | | 3/1999 | DeRouen et al. | |
| 5,951,080 | A | * | 9/1999 | Wessner | 294/150 |

FOREIGN PATENT DOCUMENTS

| | | | |
|---|---|---|---|
| FR | 2607371 | A1 | * 6/1988 |

* cited by examiner

*Primary Examiner*—Chuck Y. Mah
(74) *Attorney, Agent, or Firm*—Banner & Witcoff, Ltd.

(57) ABSTRACT

A luggage handle in the form of a closed, equilateral triangle, molded plastic loop includes latch members attached to a apex of the loop. The latch members join the ends of an adjustable length, flexible flat strap.

9 Claims, 4 Drawing Sheets

FIG.5
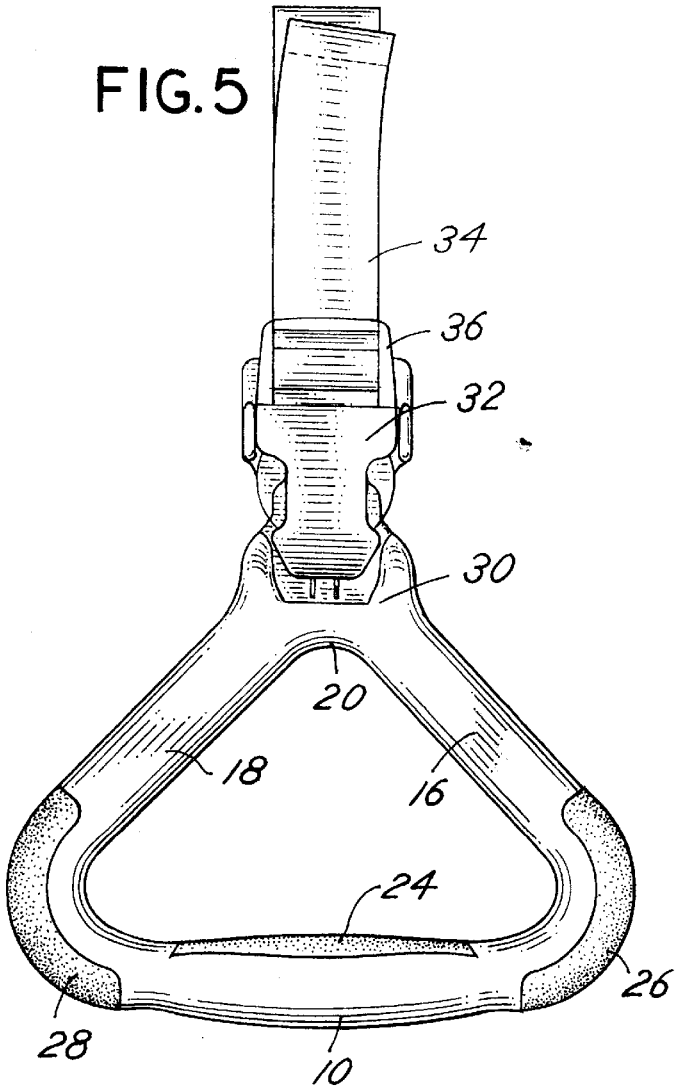
FIG.6
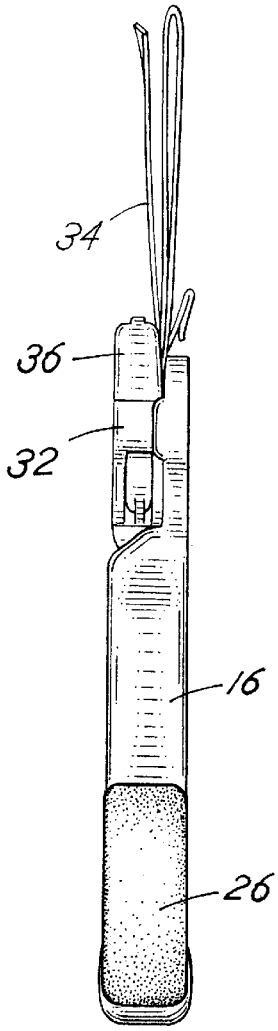
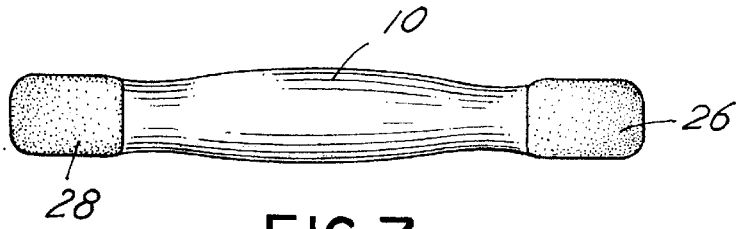
FIG.7

FIG. 8
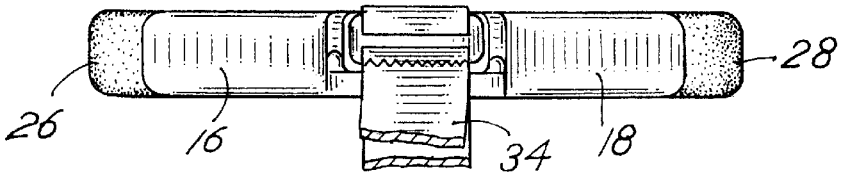
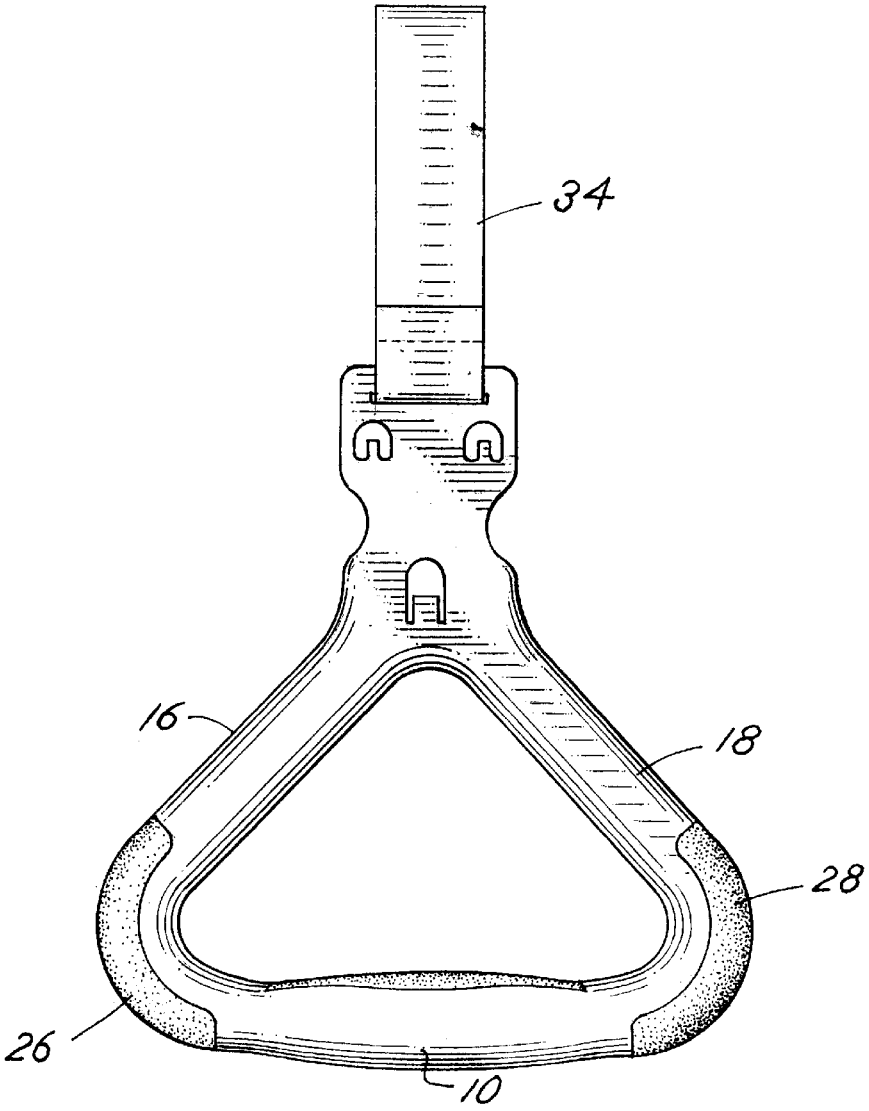
FIG. 9

LUGGAGE HANDLE

BACKGROUND OF THE INVENTION

In a principal aspect the present invention comprises a luggage handle and, more particularly, a luggage handle which may be used in combination with the pull bar of a wheeled luggage case or other luggage item having a pull handle.

Movement of luggage, especially with respect to airline travel, is often hampered by the awkwardness or cumbersome arrangement of luggage pull handles particularly on wheeled luggage. Various solutions have been proposed to accommodate such a challenge to travelers, and numerous patents tasks have been issued which disclose arrangements for transport of luggage and movement of luggage on wheels by means of a pull handle. Following is a listing of patents directed to this topic and related topics:

1. U.S. Pat. No. 3,653,474, published Apr. 4, 1972, Rolling Luggage, Sadow;
2. U.S. Pat. No. 3,913,172, published Oct. 21, 1975, Detachable Hand-Grip for Shopping Bags, Richards, deceased, et al.;
3. U.S. Pat. No. 3,924,872, published Dec. 9, 1975, Luggage with Pull Device, Sollazzi et al.;
4. U.S. Pat. No. 4,114,838, published Sep. 19, 1978, Carrier for Skis and Ski Poles, Knauf;
5. U.S. Pat. No. 4,402,542, published Sep. 6, 1983, Implement for Carrying Wheels and Tires for Motor Vehicles, Kreutzer; and
6. U.S. Pat. No. 4,558,896, published Dec. 17, 1985, Handle, Farnsworth;
7. U.S. Pat. No. 4,730,863, published Mar. 15, 1988, Apparatus for Carrying Clothing Suspended on a Coat Hangar, Guadnola;
8. U.S. Pat. No. 4,838,396, published Jun. 13, 1989, Luggage Handle, Krenzel;
9. U.S. Pat. No. 5,090,691, published Feb. 25, 1992, Active and Passive Handle for Exercise Device, Pollock;
10. U.S. Pat. No. 5,405,002, published Apr. 11, 1995, Protective Bag for Transportation of River Running Boats, Troia;
11. U.S. Pat. No. 5,566,870, published Oct. 22, 1996, Auxiliary Carrying Handle for Golf Bags, Mejeur;
12. U.S. Pat. No. 5,704,672, published Jan. 6, 1998, Stand-up Snow Shovel with Flexible Auxiliary Handle, Sims et al.;
13. U.S. Pat. No. 5,722,118, published Mar. 3, 1998, Handle Conversion Apparatus, Hansen et al.; and
14. U.S. Pat. No. 5,878,853, published Mar. 9, 1999, Luggage Pull, DeRouen et al.

While the proposed patent solutions offer various advantages depending upon the environment, there still remains the need for an improved travel or luggage handle device which is light weight, compact, easily accessed, installable whenever needed on new and old luggage, and storable. It is these objectives, among others, which have inspired the development of the present luggage handle or luggage travel handle device.

SUMMARY OF THE INVENTION

Briefly, the present invention comprises a molded handle which is typically comprised of three equal sides in the form of a triangle with one side forming a hand grip and the other two sides connected from the hand grip and joined together at an apex. The apex defines a mounting platform for first and second latch members. The first latch member is attached to the apex of the handle. The second latch member is detachable from the first member mounted on the handle and is adapted to receive a strap connected from the handle apex through the second latch member. The strap length is adjustable. The strap may be fitted around a luggage pull bar and attached to the handle by the engagement of the latch members. The strap may then be twisted 90 degrees or more to allow the luggage item to be pulled by the handle which is oriented by its user in a comfortable position. The handle includes an ergonomically designed hand grip which enhances comfortable use of the handle.

Thus it is an object of the invention to provide an improved luggage handle.

It is a further object of the invention to provide a luggage handle made from a molded plastic material which can be easily attached and detached from luggage pulls such as the pull handle associated with the telescoping handle of a wheeled bag.

Another object of the invention is to provide a luggage handle which is compact and which may be easily attached and detached from a luggage pull handle.

Another object of the invention is to provide a luggage handle which provides for balance with respect to pulling luggage items by attachment to a telescoping pull bar of luggage.

Another object of the invention is to provide a luggage handle which is inexpensive, rugged, easy to use, and which accommodates use by persons of different physical stature and height as well as luggage items having a wide variance of configurations and pull handles.

These and other objects, advantages, and features of the invention will be set forth in a detailed description which follows.

BRIEF DESCRIPTION OF THE DRAWING

In the detailed description which follows reference will be made to the drawings comprised of the following figures:

FIG. 5 is a top plan view of the handle of FIG. 4;

FIG. 6 is a side elevation of the handle of FIG. 5;

FIG. 7 is an end view of the luggage handle of FIG. 5;

FIG. 8 is an opposite end view of the luggage handle of FIG. 5; and

FIG. 9 is a bottom plan view of the luggage handle of FIG. 5.

DESCRIPTION OF THE PREFERRED EMBODIMENT

Figure 1:
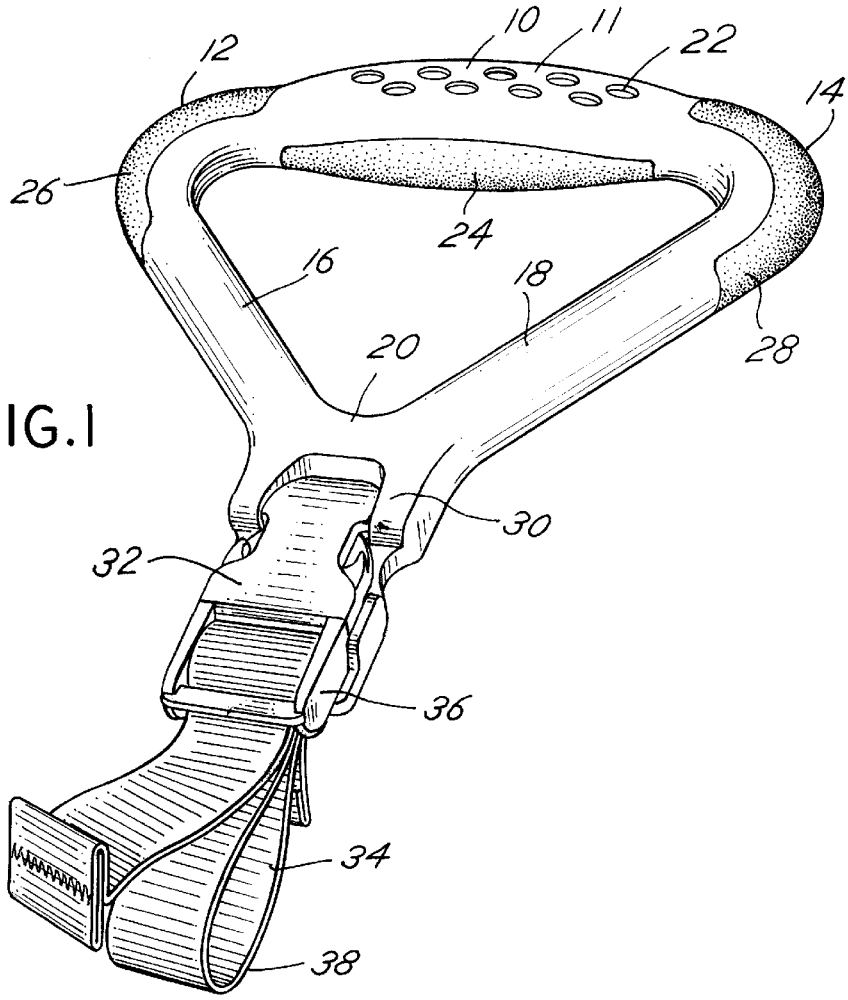
FIG. 1 is an isometric view of the luggage handle of the invention.

The luggage handle of the invention is comprised of a series of integrally molded and connected plastic bar elements preferably in the configuration of a planar triangle. The handle includes a central hand grip bar member 10 having opposite curved ends 12 and 14. Converging from the opposite ends 12 and 14 are second and third bar members 16 and 18. The bar members 16 and 18 converge to join at an apex 20. The bar members 10, 16, and 18 are preferably coplanar. The hand grip bar member 10 is preferably shaped or contoured and configured in an ergonomic manner to facilitate gripping by an individual. That is, the center portion 11 of the hand grip 10 has a greater thickness than the opposite side sections adjacent the opposite ends 12 and 14. The hand grip is smoothly rounded. In a preferred embodiment inlayed plastic and/or rubber elements 22 and 24 are provided on the bar member 10 to facilitate gripping. Additional inlay elements 26 and 28 are provided on the opposite ends 12 and 14 principally for decorative purposes and for identification purposes. The bar members 10, 16, and 18 are, in the preferred embodiment, generally equal in length and form an equilateral triangle. However the second and third bar members 16 and 18 may form the sides of an isosceles triangle joined together at the apex 20. It is possible, however, to vary the length of the second bar member 16 or third bar member 18 to control the angle or orientation of the hand grip 10.

The members 16 and 18 converge to the apex comprising a flat platform 30 upon which a first latch member 32 is mounted. The latch member 32 includes a flexible strap 34 attached thereto and extending through a second latch member 36. The extension of flexible strap 34 through the latch member 36 provides for adjustment of the length of a loop 38 formed by insertion of the second latch member 36 into the first latch member 32. Preferably the latch members 32 and 36 are positioned to engage with each other on a top side or on the same side of a platform 30 formed at the apex 20. This enhances the structural integrity of the luggage handle. It is possible, however, to provide a latch mechanism which merely fits into or engages into separate latch elements that are recessed and molded into the apex 20 where the bar members 16 and 18 are joined. Alternatively, the two latch members 32, 36 may plug into or engage with catches molded in the bar elements 16, 18 or platform 20. In such alternative embodiments, the strap 34 and latch members 32, 36 are totally detachable from the handle.

Preferably all of the bar elements, 10, 16, and 18 are coplanar with the platform 30. Further, the length of the strap 34 is preferably in the range of 12 to 20 inches to permit adequate length adjustment and to permit appropriate twisting of the strap 34.

Figure 2:
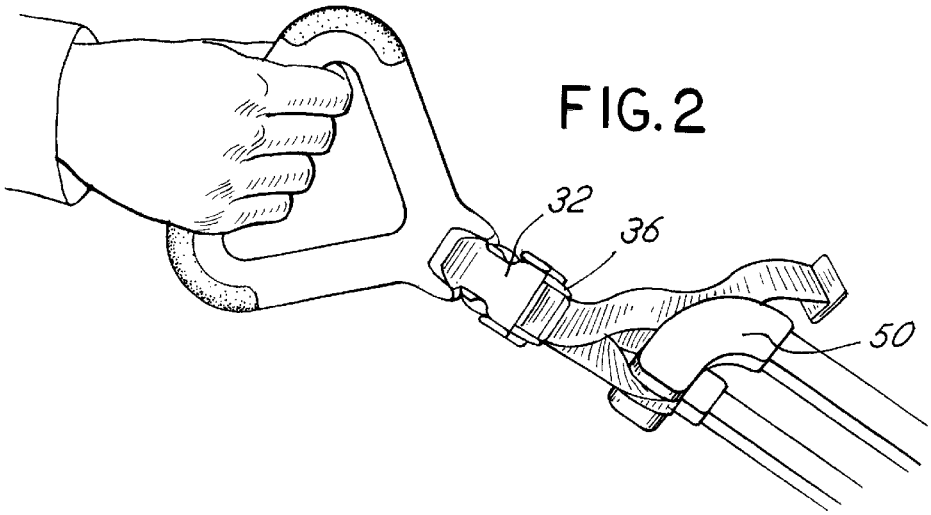
FIG. 2 is an isometric view of the luggage handle of the invention depicted in combination with a pull bar of an item of luggage.
Figure 3:
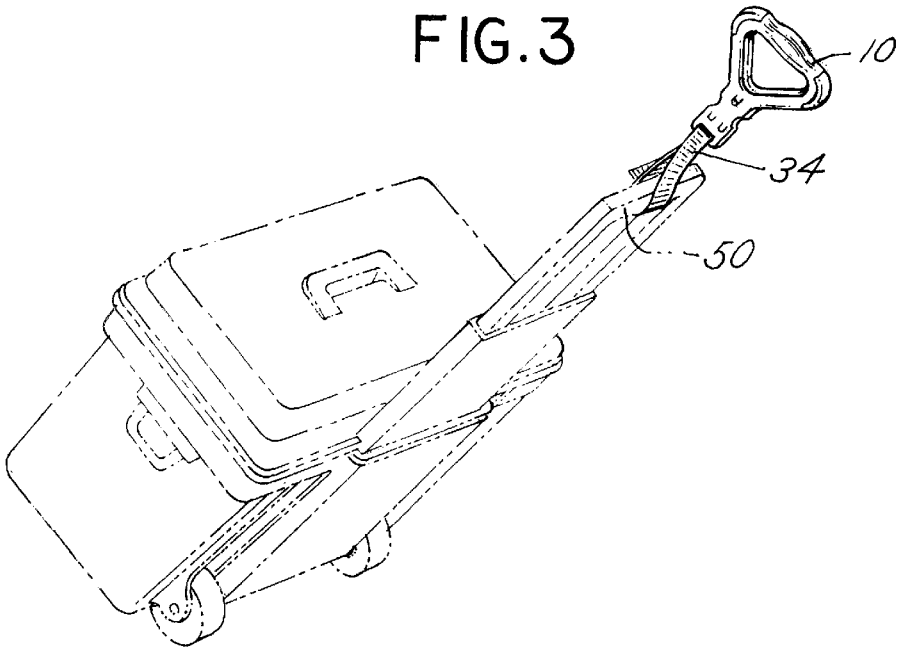
FIG. 3 is an isometric view of the luggage handle of FIG. 1 in combination with a pull handle of a luggage item.
Figure 4:
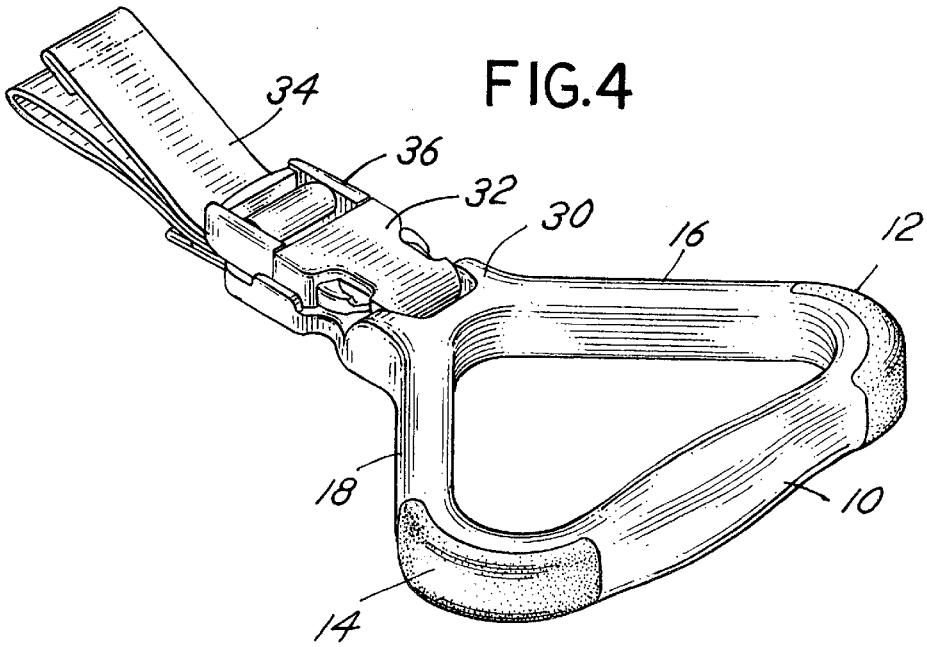
FIG. 4 is an isometric view of the luggage handle of the invention wherein the flexible strap is formed in a closed loop.

FIGS. 2 and 3 illustrate the manner in which the luggage handle is attached to a handle bar of an item of luggage, for example. Latch member 36 is disengaged from the latch member 32 and strap 34 is adjusted in length in combination with the latch member 36. The strap 34 is then fitted around a luggage handle 50. The second latch member 36 is then inserted into the first latch member 32. The bar member 10 may then be manually gripped and the strap 34 twisted (generally about 90°) so that luggage may be pulled and moved in accord with the desires of an individual toting their luggage. Thus bar 10 will typically be in a plane adjacent the side of a person using the handle as shown in FIG. 2 or 3.

It is noted that with the luggage handle of the invention, it is possible to rotate the handle and hand grip 10 relative to the luggage bar 50 thereby permitting an individual to maintain the hand grip 10 in an orientation at their side which is much more comfortable when pulling the luggage item. The strap 34 may be appropriately cinched so that the luggage item remains under full control of the user of the luggage handle while providing means for reorienting the pulling force on the luggage handle by manual operation.

Typically the respective bar members 10, 16, and 18 of the handle will be in the range of 4 to 7 inches in length and form a closed loop as depicted. Although the preferred orientation and construction provides for an equilateral triangle loop, it is possible to include additional bar elements and form a polygonal structure having more than three sides or alternatively a structure having curved bar elements. For example, the bar members 16, 18 may be appropriately curved; however, it is preferable that the hand grip bar member 10 which is to be gripped by the hand may be maintained as a relatively straight member with a cushion element and ergonomic shape in order to accommodate comfort.

It is possible to vary the construction of the handle without departing from the spirit and scope of the invention. Various materials may be used to make the handle. The configuration of the closed loop member may be varied. The position and orientation of the platform and apex may be varied as may the latch members and their attachment construction to the handle and to each other and to the strap. Importantly use of a flexible strap is considered to be an essential feature of the invention. Additionally it is preferable that the strap be adjustable in length as described. Also the width of the strap 34 is important. Typically strap 34 is ¾ inch to 2 inches wide and the strap is flat to facilitate positioning on a pull handle and maintenance of position. Thus while it has been set forth a preferred embodiment of the invention, it is to be understood that the invention is limited only by the following claims and equivalents thereof.

What is claimed is:

1. A luggage handle comprising, in combination:

a solid hand grip member including a first bar member, a second bar member and a third bar member, said bar members being co-planar and joined in the form of a planar triangle, wherein two bar members form the sides of the triangle and join at an apex, said bar member forming the third side of the triangle being configured to provide a hand grip;

a connection member at the apex of the first and second bar members including a first clamp member;

a flexible, elongate, flat strap having one end attached to and extending from the connection member;

a second adjustable clamp member connectable to the first clamp member and also adjustably attached to the strap to permit adjustment of the length of the strap between the clamp members, said first and second clamp members engageable to form in combination with the strap a closed loop length of said flexible strap for fitting around a handle of an item of luggage and capable of twisting the loop formed by the strap at least in about 90° when engaging a luggage item.

2. The luggage handle of claim 1 wherein the hand grip member has the form of an equilateral triangle.

3. The luggage handles of claim 1 wherein the clamp members hold the strap coplanar with the handgrip member.

4. The luggage handle of claim 1 wherein the bar members form an isosceles triangle.

5. A luggage tote handle for attachment to and toting of an item of luggage by engaging a luggage pull bar, said luggage tote handle comprising, in combination:

a rigid, multi sided hand grip member including at least three continuous, connected bar member sides joined to form a loop with a first generally straight hand member side having a first end and a second end, said remaining sides comprising a link connecting the first and second ends to form said loop and having a connection apex, said sides being coplanar;

a first latch mounted on the hand grip member at the apex;

a second latch cooperative with and connectable to the first latch;

a flexible strap having a first end attached to the apex and a second end attached to the second latch, said flexible strap forming a flexible, adjustable length closed strap loop having an adjustable length upon connection of the latches and fitting the strap around a pull bar, said strap capable of twisting at least about 90° relative to the grip member loop when engaging said pull bar.

6. The tote handle of claim 5 wherein the bar member sides are coplanar.

7. The tote handle of claim 5 wherein the hand grip member is comprised of three sides in the form of an isosceles triangle with the apex at the juncture of the two equal sides.

8. The tote handle of claim 5 wherein the hand grip member is an equilateral triangle.

9. A tote handle for pulling luggage by connection to a handle bar for said luggage, said tote handle comprising, in combination:

a generally equilateral triangle shaped grip comprised of first, second and third generally straight bar members forming a closed loop, one of said bar members comprising a hand hold member and the other two members connected to an apex comprising a latch connection;

an elongate flexible strap having a first end attached to the latch connection and a second free end;

a latch member attached to the strap at an adjustable position along the length of the strap; and said latch member attachable to the latch connection, said strap comprising a loop capable of fitting around the handle bar of luggage and twisting to accommodate the orientation of a luggage handle bar relative to the hand hold member and simultaneously provide separation of the luggage handle bar relative to the hand hold member.

* * * * *